US010450167B2

(12) United States Patent
Yang

(10) Patent No.: US 10,450,167 B2
(45) Date of Patent: Oct. 22, 2019

(54) MIDDLE-DRIVE TYPE ELEVATOR

(71) Applicant: Shanghai Yangtze 3-map Elevator Co., LTD., Shanghai (CN)

(72) Inventor: Zhiyong Yang, Shanghai (CN)

(73) Assignee: SHANGHAI YANGTZE 3-MAP ELEVATOR CO., LTD., Shanghai (CN)

( * ) Notice: Subject to any disclaimer, the term of this patent is extended or adjusted under 35 U.S.C. 154(b) by 260 days.

(21) Appl. No.: 15/198,547

(22) Filed: Jun. 30, 2016

(65) Prior Publication Data

US 2017/0001840 A1 Jan. 5, 2017

(30) Foreign Application Priority Data

Jun. 30, 2015 (CN) ..... 2015 1 0385811
Jan. 20, 2016 (CN) ..... 2016 2 0049403 U

(51) Int. Cl.
*B66B 11/00* (2006.01)
*B66B 11/08* (2006.01)
*B66B 7/06* (2006.01)

(52) U.S. Cl.
CPC ..... *B66B 11/008* (2013.01); *B66B 7/06* (2013.01); *B66B 11/08* (2013.01)

(58) Field of Classification Search
CPC ..... B66B 7/06; B66B 11/0065; B66B 11/008; B66B 11/08
See application file for complete search history.

(56) References Cited

U.S. PATENT DOCUMENTS 669,603 A * 3/1901 Stauffacher ..... F25D 1/02 187/263
741,827 A * 10/1903 Potter ..... B66B 11/008 187/260
2,522,614 A * 9/1950 Helling ..... B66B 11/08 187/260
4,030,569 A * 6/1977 Berkovitz ..... B66B 15/04 187/254
4,591,025 A * 5/1986 Honda ..... B66B 11/08 187/254
4,842,101 A * 6/1989 Lamb ..... B66B 11/08 187/266

(Continued)

FOREIGN PATENT DOCUMENTS

CN 204508509 7/2015

*Primary Examiner* — Minh Truong
(74) *Attorney, Agent, or Firm* — Muncy, Geissler, Olds & Lowe, P.C.

(57) ABSTRACT

A middle-drive type elevator has a lift car, tractor, wire rope, guide pulley and counterweight device. The tractor is installed between the lift car and guide pulley. Both the tractor and guide pulley are disposed above the lift car. The tractor is located below the guide pulley. One end of the wire rope connects to the top of the counterweight device, and the other end connects to the top of the lift car after passing through the guide pulley and a traction wheel on the tractor successively. To make the tractor arranged in the middle, the guide pulley bears the majority of the weight of the lift car and counterweight device, while the tractor only bears the minority of the weight of the lift car and counterweight device. It can effectively reduce the load borne by the tractor and greatly improve the service life of the tractor.

3 Claims, 2 Drawing Sheets

(56) References Cited

U.S. PATENT DOCUMENTS

| | | | | | |
|---|---|---|---|---|---|
| 5,370,205 | A * | 12/1994 | Vanhala | B66B 11/08 | 187/264 |
| 5,792,294 | A * | 8/1998 | Randazzo | B29C 65/00 | 156/158 |
| 6,247,557 | B1 * | 6/2001 | Kobayashi | B66B 11/008 | 187/251 |
| 7,543,685 | B2 * | 6/2009 | Ach | B66B 11/004 | 187/250 |
| 9,856,113 | B2 * | 1/2018 | Lehtinen | B66B 7/06 | |
| 2015/0166304 | A1 * | 6/2015 | Roberts | B66B 5/022 | 187/278 |

* cited by examiner

MIDDLE-DRIVE TYPE ELEVATOR

FIELD OF THE INVENTION

The present invention relates to the technical field of elevator, especially to a middle-drive type elevator.

BACKGROUND TECHNOLOGY

Elevator is a type of vertical means of transportation under traction of tractor, which is also indispensable and important conveying equipment in carrying passengers and cargos in multi-story buildings and in high-rise buildings.

In the current technology, as shown in FIG. 1, the Chinese Utility Model patent named "A New Type of Steel Belt Elevator" with Chinese Patent Publication Number CN204508509U discloses a new type of steel belt elevator, including a traction wheel 11 and the traction wheel 11 connected with a steel belt 12; one end of the steel belt 12 connects to a lift car 14 through a overhead lift car pulley 13, and the other end of the steel belt 12 connects to a counterweight device 6 through a guide pulley 5.

It can be known from the above-mentioned structural setting of the patent that although the traction wheel is located between the guide pulley and the lift car, but the traction wheel is located above the guide pulley, which causes the traction wheel bearing the vast majority of the weight of the lift car and the counterweight device; this kind of acting form of the load is mainly caused by the limitation of the structural design of traditional elevator; the negative effect caused by such disadvantage will directly lead to the great reduction of the service life of the tractor.

How to reduce the load borne by the tractor is the premise to effectively enhance the service life of the tractor. In view of this, the corresponding solution for such technical problem is provided hereof.

SUMMARY

The present invention provides a middle-drive type elevator, which can effectively reduce the load borne by the tractor and therefore can greatly improve the service life of the tractor.

In order to achieve the above-mentioned objective, the technical solution to solve the technical problems is stated as follows:

A middle-drive type elevator, it comprises:

a lift car;

a tractor;

a wire rope, a guide pulley and a counterweight device, wherein:

the tractor is installed between the lift car and the guide pulley;

both the tractor and the guide pulley are disposed above the lift car, and the tractor is located below the guide pulley;

one end of the wire rope connects to the top of the counterweight, and the other end connects to the top of the lift car after passing through the guide pulley and the traction wheel on the tractor successively.

Furthermore, the tractor and the guide pulley are connected through the combination of full-wound and semi-wound of the wire rope.

As an optimization, the tractor is located at the lower right of the guide pulley. Further more, the angle between the line that between the traction wheel center and the guide pulley center and the horizontal plane is β, and the range value of the β is between 0°-90°.

Preferably, the range value of the β s 40°-75°.

Preferably, the best value of the β is 45°.

Due to the application of the above-mentioned technical solution, the present invention has the following advantages and positive effects when compared with current technologies:

In this invention, through the middle arrangement method of the tractor, the guide pulley is made to bear the majority of the weight of the lift car and the counterweight device, and the tractor only bears the minority of the weight of the lift car and the counterweight device. Thus, it can effectively reduce the load borne by the tractor and greatly improve the service life of the tractor.

BRIEF DESCRIPTION OF THE DRAWINGS

In order to explain the technical solution of the embodiment in this invention more clearly, a brief introduction is given below to the attached figures which are used during the description of embodiment. It is obvious that the attached figures cited in the following description are only some embodiments of this invention, and the technicians in this field can acquire other attached figures according to these attached figures on the premise of not contributing inventive efforts, wherein:

In FIG. 1: 11—a traction wheel; 12—a steel belt; 13—an overhead lift car pulley; 14—a lift car; 15—a guide pulley; 16—a counterweight device;

In FIG. 2: 1—a lift car; 2—a tractor; 3—a wire rope; 4—a guide pulley; 5—a counterweight device; 6—a traction wheel.

DETAILED DESCRIPTION OF THE EMBODIMENTS

In the following, combining with the attached figures of this invention, a clear and complete description and discussion is made on the technical solution of the embodiment. Obviously, only some embodiments of this invention are described instead all of them. Based on the embodiments of this invention, all other embodiments obtained by ordinary technicians in this field on the premise of not contributing inventive efforts belong to the protection scope of this invention.

Figure 1:
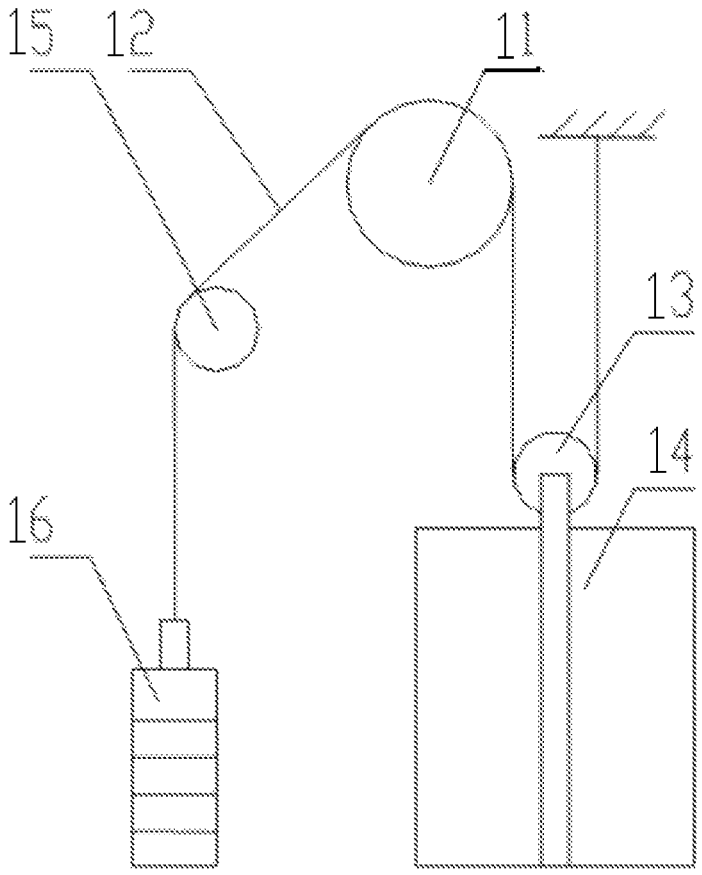
Fig. 1 Prior Art
FIG. 1 is the schematic diagram of the integral structure of a kind of driven elevator under the current technology.
Figure 2:
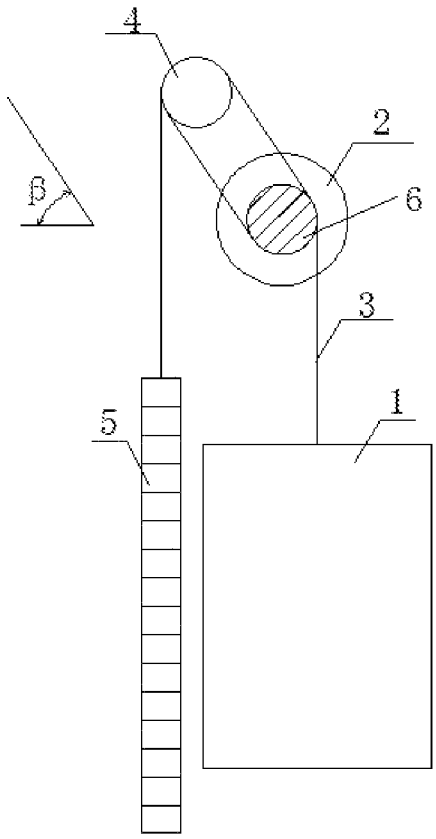
FIG. 2 is the schematic diagram of the integral structure of a middle-drive type elevator according to the present invention.

As shown in FIG. 2, the embodiment discloses a middle-drive type elevator, it comprises a lift car 1, a tractor 2, a wire rope 3, a guide pulley 4 and a counterweight device 5, wherein:

the tractor 2 is installed between the lift car 1 and the guide pulley 4; both the tractor 2 and the guide pulley 4 are disposed above the lift car 1, and the tractor 2 is located below the guide pulley 4;

one end of the wire rope 3 connects to the top of the counterweight device 5, and the other end connects to the top of the lift car 1 after passing through the guide pulley 4 and the traction wheel 6 on the tractor 2 successively.

Further more, the tractor 2 is located below the guide pulley 4. As an optimization, the tractor 2 is located at the lower right of the guide pulley 4; at the same time, the lift car 1 is located at the lower right of the whole elevator system; and the counterweight device 5 is located at the lower left of the whole elevator system.

The emphasis of the above-mentioned design is that it can minimize the load borne by the tractor 2 to prevent the tractor 2 from bearing the majority of the load under the current technology, so as to transfer the load of the lift car 1 to the guide pulley 4 in the elevator system. At the same time, because the manufacturing cost of the guide pulley 4 is much less than the traction wheel 2, it can greatly reduce the cost of the whole elevator system. In this embodiment, the middle-drive type means that the tractor 2 is installed between the lift car 1 and the guide pulley 4.

In elevator field, disposing a tractor above a guide pulley is generally conventional practice, because it is in line with the principle of general structure mechanics and can provide a larger mechanical drive force to the lift car. Under this approach, the wire rope that connects the tractor and the guide pulley has to use either of full-wound or semi-wound type to wind, wherein, the full-wound type is that each wire rope winds around the tractor twice, therefore two corresponding rope groove are needed; the semi-wound type is that each wire rope winds around the tractor once, therefore only one corresponding rope groove is needed. But both the two types have a defect that the tractor bears the most weight of the lift car and the counterweight device, which causes the working life of the tractor is shortened greatly.

The practice of disposing the tractor below the guide pulley used by the present invention, theoretically, goes against the conventional mechanics principle, and to overcome this problem, the present invention overcome the problem through a newly winding type of the wire rope between the tractor and the guide pulley. In particular, corresponding to the structure that the tractor is disposed below the guide pulley, the wind type of the wire rope 3 of the present invention uses mixing wind type of combination of full-wound and semi-wound, wherein the full-wound increases the contact area between the wire rope 3 and the tractor 2 as well as the guide pulley 4, to improve driving force, and the semi-wound improves the safety performance, which is because the semi-wound type needs only one corresponding rope groove, in the case of that the amounts of the rope groove disposed are fixed, the semi-wound type can increase the amount of the wire rope contrary to the full-wound type, and in the elevator field, the more the amount of the wire rope are, the larger the safety factor is.

In selected embodiment, the tractor 2 locates at the lower right of the guide pulley 4, and at this time, the lift car 1 locates at the lower right of the entire elevator system, and the counterweight device 5 locates at the lower left of the entire elevator system.

Furthermore, the angle between the lines that between the traction wheel 6 center and the guide pulley 4 center and the horizontal plane is β, and the range of the β is between 0°-90°. In the optimized embodiment, the range value of the β is 40°-75°. The value of β directly determines the load level of the tractor 2. It can be known from FIG. 2 that the tractor 2 in the embodiment is located at the lower right of the guide pulley 4, and the value of β is 56° for example; and the lift car 1 is located below the tractor 2. In this embodiment, the best value of the β is 45°.

Specific working principle and the technical effect of the elevator is as follow:

The tractor 2 of the elevator as a drive part is installed between the lift car 1 and the guide pulley 4; the lift car 1 is hung by one end of the wire rope 3 after the end of the wire rope 3 passing through the guide pulley 4 and the traction wheel 6 on the tractor 2; and the counterweight device 5 is hung by the other end of the wire rope 3; the traction force caused by the friction between the wire rope 3 and the wheel groove of the traction wheel 6 drives the lift car 1 to run up and down. Through the middle arrangement of the tractor 2, the guide pulley 4 bears the majority of the weight of the lift car 1 and the counterweight device 5, and the tractor 2 bears only the minority of the weight of the lift car 1 and the counterweight device 5; thus, it can effectively reduce the load borne by the tractor 2 and greatly improve the service life of the tractor 2.

The contents mentioned above are only some better embodiments of this invention, and the protection scope of this invention is not limited herein. Any modification or substitution that can be easily thought of by any technicians familiar with this technology within the technical scope disclosed by this invention shall be covered within the protection scope of this invention. Therefore, the protection scope of this invention shall be subject to the protection scope as required in the claim.

The invention claimed is:

1. A middle-drive type elevator, consisting of:

a lift car;

only one tractor;

a wire rope;

only one guide pulley and a counterweight device, wherein:

the tractor is disposed between the lift car and the guide pulley;

both the tractor and the guide pulley are disposed above the lift car, and the tractor is located below the guide pulley, to minimize the load borne by the tractor;

one end of the wire rope connects to the top of the counterweight device, and the other end connects to the top of the lift car after passing through the guide pulley and a traction wheel on the tractor successively;

wherein the tractor and the guide pulley are connected through full-wound of the wire rope, the number of rope grooves on the traction wheel is twice the number of the wire rope to accommodate the wire rope, and the wire rope winds around the tractor twice;

wherein an angle between a line between a center of the traction wheel and a center of the guide pulley and a horizontal plane is β, and a range value of the β is between 40°-75 °.

2. The middle-drive type elevator of claim 1, wherein the tractor is located at a position opposite the counterweight device according to a vertical line penetrating a center of the guide pulley.

3. The middle-drive type elevator of claim 1, wherein the range value of the β is 45°.

* * * * *